United States Patent [19]

Holahan et al.

[11] 4,364,104

[45] Dec. 14, 1982

[54] NOVELTY LIGHT

[75] Inventors: Edward T. Holahan, Chicago; Burton C. Meyer, Downers Grove, both of Ill.

[73] Assignee: Marvin Glass & Associates, Chicago, Ill.

[21] Appl. No.: 198,722

[22] Filed: Oct. 20, 1980

[51] Int. Cl.[3] ..... F21S 3/00

[52] U.S. Cl. ..... 362/223; 362/109; 362/119; 362/120; 362/186; 362/202; 362/205; 362/208; 362/217; 362/285; 362/287; 362/295; 362/311; 362/362; 362/372; 362/802; 362/32

[58] Field of Search ..... 362/32, 109, 119, 120, 362/186, 202, 205, 208, 217, 223, 285, 287, 295, 311, 362, 372, 802

[56] References Cited

U.S. PATENT DOCUMENTS

| | | | |
|---|---|---|---|
| 2,816,215 | 12/1957 | Jarred | 362/202 |
| 3,934,539 | 1/1976 | Little et al. | 362/34 X |
| 4,210,797 | 7/1980 | Tomaro | 362/199 X |

*Primary Examiner*—Stephen J. Lechert, Jr.
*Attorney, Agent, or Firm*—McDermott, Will & Emery

[57] ABSTRACT

This invention relates to a novelty or foldable toy light having an appearance similar to that of a switchblade knife. The light includes a housing with an extensible element which rotates from a position within the housing to a position extending away from the housing. A lamp within the extensible element powered by batteries within the housing illuminates the extensible element which is made of light conveying material. The lamp is activated by a rotary switch within the housing so that the extensible element is illuminated in response to outward rotation of the extensible element.

10 Claims, 7 Drawing Figures

NOVELTY LIGHT

BACKGROUND OF THE INVENTION

1. Field of the Invention

This invention relates generally to amusement devices and more particularly to toy lights and knives.

2. Brief Description of the Prior Art

Toy knives designed to prevent injury to the user are well known in the art. It has long been recognized that young children who have a fascination for playing with knives often do not have the physical coordination to do so safely.

SUMMARY OF THE INVENTION

The present invention is a toy light which includes a housing with an extensible element mounted for rotation from a position within the housing to a position extending away from the housing. The light includes means for internally illuminating the element when the element is in its outwardly extending position.

DESCRIPTION OF THE PREFERRED EMBODIMENT

Figure 1:
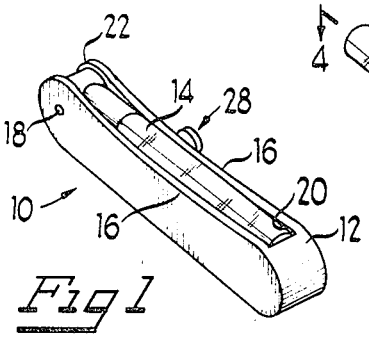
FIG. 1 is a perspective view of one embodiment of the present invention.

Referring to the drawing wherein like reference characters are used for like parts through-out, there is shown in FIG. 1 a toy light 10 including a housing 12 and an extensible element 14. The housing 12, generally in the shape of a pocket knife, includes a pair of opposed lateral walls 16 creating an element receiving receptacle 20 between them. The extensible element 14 is mounted on one end on a pin 18 rotatably retained between walls 16 near end 22 to enable the extensible element 14 to rotate from its closed position shown in FIG. 1 to its open, extended position shown in FIG. 2.

Figure 2:
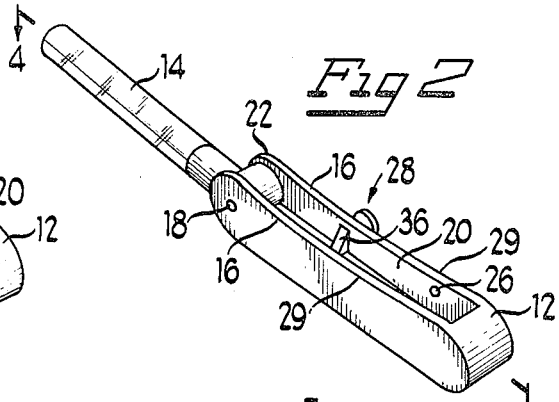
FIG. 2 is a perspective view of the embodiment shown in FIG. 1 with the extensible element extending outwardly of the housing.
Figure 3:
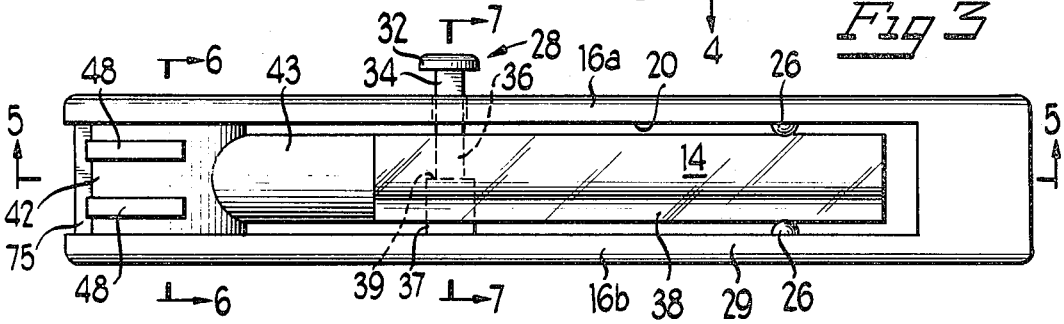
FIG. 3 is an enlarged plan view of the embodiment shown in FIG. 1.
Figure 7:
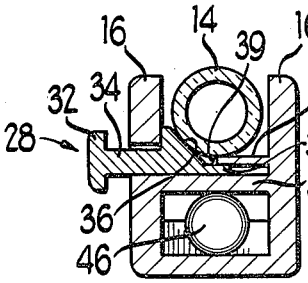
FIG. 7 is a cross-sectional view taken generally along line 7—7 in FIG. 3.

The rotation of the extensible element from the position shown in FIG. 1 to the position shown in FIG. 2 is controlled by the rounded tabs 26, manually operated cam 28 and coiled spring 30. As shown in FIG. 3, the tabs 26 extend inwardly from the interior side 20 of each opposed lateral wall 16 near its upper edge 29. Since the extensible element 14 is tubular and the distance between the opposed tabs 26 is less than the diameter of the element 14 the element 14 is retained within receptacle 20 beneath the tabs 26. The element 14 is freed from its retained position beneath tabs 26 by manually operated cam 28 slidably retained within and extending to either side of wall 16, as shown in FIGS. 3 and 7. The cam 28 includes a flanged contact member 32 extending outside of housing 12, a shaft 34 slidably retained within wall 16*a* and a cammed surface 36 located within receptacle 20. Depression of the flanged contact member 32 towards housing 12 causes inward movement of the shaft 34 in which turn forces cammed surface 36 to slide across receptacle 20 and to wedge the extensible element 14 upwardly, flexing tabs 26 and walls 16 outwardly until element 14 moves past tabs 26. As shown in FIG. 7, the movement of cammed surface 36 is guided by its flattened end 35 which slides beneath a U-shaped plate 37 attached to the opposite wall 16*b* and is eventually arrested by stop surface 39 located centrally between walls 16 on the end of plate 37.

Figure 4:
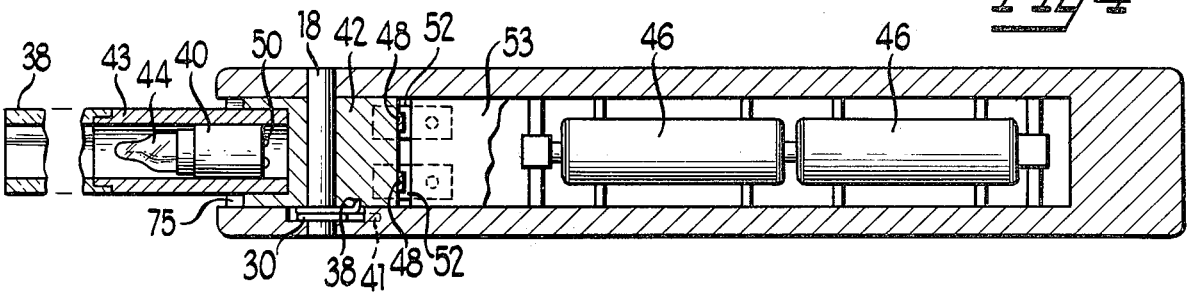
FIG. 4 is an enlarged, partial, cross-sectional view taken generally along line 4—4 in FIG. 2.
Figure 6:
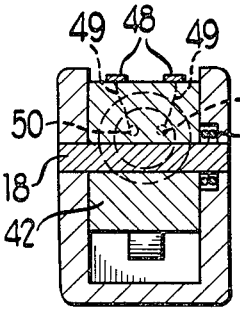
FIG. 6 is a cross-sectional view taken generally along line 6—6 in FIG. 3.

Once the element 14 is free of tabs 26, it is propelled outwardly by the action of coiled spring 30 shown in FIGS. 4 and 6. One end 38 of coiled spring 30 is secured to the element 14 and the other end 41 of the spring 30 is secured to the housing 12. The spring 30 is biased by the rotation of the element 14 into the housing 12 from its relaxed state when the element is in its outwardly extending position. The element 14 continues to rotate until it comes to rest against stop 75, preferably after about 180° of rotation.

Figure 5:
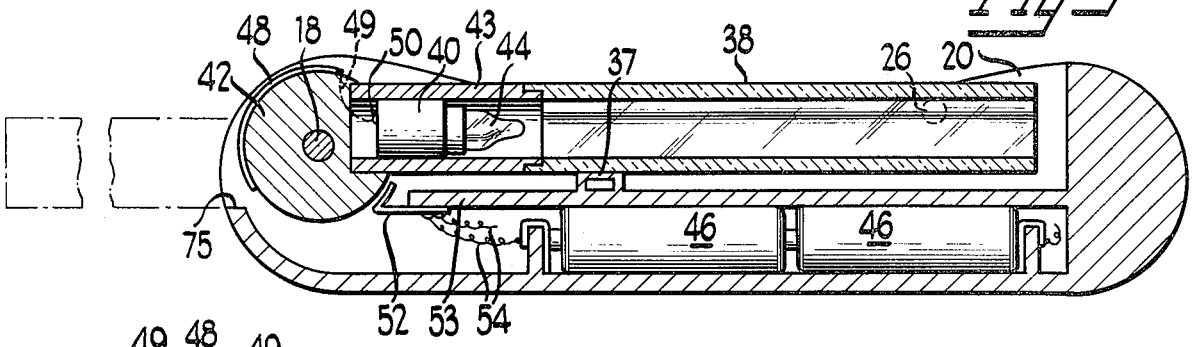
FIG. 5 is a cross-sectional view taken generally along line 5—5 in FIG. 3.

As shown in FIG. 5, the extensible element 14 includes a light pipe 38 preferably made of hollow light conveying material such as lucite, and is frictionally fitted on a tubular base 43. A lamp socket 40 is secured within the base 43 of the light pipe 38. A disc 42 mounted for rotation around pin 18 and lamp socket 40 is connected to base 43. The lamp socket 40 includes electrical contacts (not shown) that connect a replaceable lightbulb 44 held within socket 40 to a power source 46, such as batteries located in housing 12 beneath receptacle 20, through rotating electrical contacts 48. The rotating contacts 48 extend over approximately 100° of the circumference of the disc 42. The terminals 50 of lamp socket 40 are electrically connected by wires 49 to the rotating contacts 48 through the disc 42. A complete circuit is established when the element 14 rotates approximately 90° to its upwardly extending position (not shown) from the closed position shown in FIG. 1 so that the rotating contacts 48 are contacted by the biased sliding electrical contacts 52. The biased contacts 52, attached to the lower surface 53 of receptacle 20 are connected by wires 54 to power source 46 as shown in FIG. 5.

The light 10 operates as follows. With the element 14 in the position shown in FIG. 3, manually operated cam 28 is actuated by pressing flanged contact member 32 inwardly moving cammed surface 36 against extensible element 14. The upward force applied by the cammed surface 36 overcomes the securement of the element 14 beneath the tabs 26. This permits the element 14 to rotate around pin 18 accelerated by the action of coiled spring 30. Once the element 14 has rotated approximately 90°, rotating contacts 48 electrically contact the biased contacts 52 illuminating the bulb 44 in lamp socket 40. The bulb 44 remains illuminated as the element 14 continues to rotate to its full outwardly extending position shown in FIG. 2. If the light pipe 38 is made of light conveying material, it will appear to glow due to the transmission of light from the bulb 44 through the light pipe 38.

The element 14 can then be returned to the receptacle 20 by grasping the element 14 and rotating it in a reverse direction to that through which it rotated previously. Once the element 14 passes through the upwardly extending position after approximately 90° of rotation, the contacts 48 disconnect from contacts 52 disconnecting the power source 46 and extinguishing bulb 44. The element 14 is locked within the receptacle 20 by pressing it past the tabs 26 and against the cammed surface 36, returning the cam 28 to its original position. The element 14 then rests against the plate 37 and the cammed surface 36 as shown in FIG. 7.

Many modifications and variations of the present invention are possible in light of the above teaching. Thus, it is to be understood that, within the scope of the intended claims, the invention may be practiced other than as specifically described above.

What is claimed and desired to be secured by Letters Patent of the United States is:

1. A toy light, comprising:

a housing;

an extensible element mounted for rotation from a position within said housing to a position extending away from said housing;

means for biasing said element to its outwardly extending position;

means for releasably retaining said element in a position within said housing; and means for internally illuminating said element when it is in its outwardly extending position.

2. The toy light of claim 1 including switch means for automatically illuminating said element in response to rotation of said element from a position within said housing to a position extending away from said housing.

3. The toy light of claim 1 wherein said housing is in the shape of a pocket knife.

4. The toy light of claim 1 wherein said extensible element is at least partially made of light conducting material.

5. The toy light of claim 1 wherein said switch means is a rotary contact switch.

6. The toy light of claim 1 including means for frictionally retaining said extensible element within said housing and including a manual actuator for forcing said element out of said housing.

7. The toy light of claim 6 wherein said actuator includes cam means for wedging said element from said housing.

8. The toy light of claim 1 wherein said element is spring biased to its outwardly extending position.

9. The toy light of claim 1 wherein said extensible element rotates from a position interior of said housing approximately 180° to a position extending directly away from said housing.

10. The toy light of claim 9 wherein said illuminating means illuminates said element after about ninety degrees of rotation and maintains the illumination of said element until said element is rotated back to a position approximately ninety degrees from said housing.

* * * * *